US005221952A

United States Patent [19]

Ishii et al.

[11] Patent Number: 5,221,952

[45] Date of Patent: Jun. 22, 1993

[54] MEANS FOR SEPARATING IMAGE RECORDING MEDIUM IN ELECTROPHOTOGRAPHIC RECORDING APPARATUS

[75] Inventors: Masato Ishii; Masanori Tokuhisa, both of Kawasaki; Hirohiko Kubo, Hyogo, all of Japan

[73] Assignee: Fujitsu Limited, Kawasaki, Japan

[21] Appl. No.: 933,677

[22] Filed: Aug. 24, 1992

[30] Foreign Application Priority Data

Sep. 2, 1991 [JP] Japan ..... 3-220829

[51] Int. Cl.[5] ..... G03G 15/00

[52] U.S. Cl. ..... 355/315; 271/310; 271/900

[58] Field of Search ..... 355/315; 271/307, 310, 271/312, 900

[56] References Cited

U.S. PATENT DOCUMENTS 4,579,441 4/1986 Hart et al. ..... 271/900 X
4,699,499 10/1987 Hoshika et al. ..... 271/900 X
4,782,358 11/1988 Shibayama et al. ..... 355/315

FOREIGN PATENT DOCUMENTS 1-235978 9/1989 Japan ..... 355/315

OTHER PUBLICATIONS

English Abstract of Japanese Kokai 53-104246, Published Nov. 9, 1978.
English Abstract of Japanese Patent Document 2-135385, Published May 24, 1990.

*Primary Examiner*—R. L. Moses
*Attorney, Agent, or Firm*—Staas & Halsey

[57] ABSTRACT

An electrophotographic recording apparatus including a light-sensitive drum for carrying toner images developed thereon, and a transfer unit arranged at a prescribed distance from the light-sensitive drum for transferring the toner images from a light-sensitive drum to the image recording paper. The transfer unit has a charging wire electrode for electrically charging the paper and a generally inverted U-shaped housing having spaced sidewalls with respective bottom edges. A separator is provided for separating the paper from the light-sensitive drum as the paper travels along a conveying path and comprises a paper separating plate extending from the downstream one of the bottom edges of the housing of the transfer unit in the downstream direction of the travel of the paper along the conveying path side thereof, with and the housing of the transfer unit is grounded. The paper separating plate has a distal end having a saw tooth shape along the length thereof, as measured transversely to the conveying path.

5 Claims, 2 Drawing Sheets

MEANS FOR SEPARATING IMAGE RECORDING MEDIUM IN ELECTROPHOTOGRAPHIC RECORDING APPARATUS

BACKGROUND OF THE INVENTION

1. Field of the Invention

The present invention relates to means for separating an image recording medium from an image carrier after a transfer of toner images from the image carrier to the image recording medium in an electrophotographic recording apparatus.

2. Description of the Related Art

Widespread use of office automation systems requires high quality output apparatuses in which ordinary paper can be used. For this purpose, electrophotographic recording apparatuses such as copying machines and facsimile apparatuses have been realized, and are disclosed, for example, in Japanese Unexamined Patent Publication (Kokai) No. 53-104246 and No. 2-135385. The electophotographic recording apparatuses include an image carrier such as a light-sensitive drum carrying toner images developed thereon, conveying rollers for conveying an image recording medium such as paper to the image carrier in a predetermined direction for transferring the toner images from the image carrier to the image recording medium, and a transfer unit arranged at a specified distance from the image carrier and having a charging wire electrode causing a corona discharge for electrically charging the image recording medium. The transfer unit typically charges the image recording medium to a plus potential to which minus charged toner on the image carrier is attracted.

In these electrophotographic recording apparatuses, the image recording medium is brought into contact with the image carrier at a certain contact portion for transferring the toner images from the image carrier to the image recording medium and then the image recording medium is disengaged from the image carrier for directing the image recording medium to a fixing process. However, the image recording medium is apt to be attracted to the image carrier after the toner images are transferred from the image carrier to the image recording medium. Therefore, it is necessary to separate the image recording medium from the image carrier so that the transferred images are not disturbed, to obtain high quality products jamming of the image recording medium does not occur.

To separate the image recording medium from the image carrier, it is known to provide a DC separating structure comprising a row of deelectrification needles on the downstream side of the transfer unit as viewed from the paper conveying direction, the needles being connected to a minus pole of a power source to pull the plus charged image recording medium and thereby to separate the image recording medium from the image carrier. However, the DC separating structure requires a large expenditure for arranging, for example, a plurality of deelectrification needles.

A curvature separating structure is also known in which the radius of curvature of the image carrier (light-sensitive drum) is made smaller and the image recording medium departs from the image carrier at a relatively large angle between the image recording medium and the tangent line to a certain point of the image carrier. In this case, however, the available surface area of the image carrier is small and the limited surface is used excessively, thereby shortening the life of the image carrier. Further, a face-up separating structure is also known in which the image recording medium is conveyed under the image carrier thereby to engage same from below and thus the separation of the image recording medium from the image carrier is assisted by the weight of the image recording medium. In this case, however, there are restrictions in designing the face-up separating structure rather than the face-down separating structure.

The above described Japanese Unexamined Patent Publication (Kokai) No. 53-104246 and No. 2-135385 also disclose means for separating the image recording medium from the image carrier. In Kokai No. 53-104246, the means for separating the image recording medium from the image carrier comprises a conductive guide roller and a dielectric material covering the conductive guide roller, with the conductive guide roller being connected to the ground or a minus pole of a power source. In Kokai No. 2-135385 , the means for separating the image recording medium from the image carrier comprises a conductive guide plate and a dielectric layer sandwiching the conductive guide plate, with the conductive guide plate being connected to a minus pole of a power source. It is said that if the conductive guide roller or plate directly contacts the image recording medium, the conductive guide roller or plate may disturb the toner images on the image recording medium and so the dielectric layer is provided to prevent the conductive guide roller or plate from directly contacting the image recording medium. In these publications, the means for separating the image recording medium from the image carrier is provided as a special component in addition to the transfer unit. Therefore, these means increase the manufacturing cost of the apparatus.

SUMMARY OF THE INVENTION

The object of the present invention is to provide a means for separating an image recording medium from an image carrier by which the image recording medium can be separated from the image carrier with undisturbed images and can be obtained at a low cost.

According to the present invention, in an electrophotographic recording apparatus including an image carrier for carrying toner images developed thereon, means for conveying an image recording medium to the image carrier in a predetermined direction, and a transfer unit arranged at a distance between the image carrier and the transfer unit for transferring the toner images from the image carrier to the image recording medium and having means electrically charging the image recording medium and a generally inverted U-shaped outer case with bottoms near the image recording medium; one of the bottoms being on the downstream side of the other as viewed from the conveying direction of the image recording medium, means for separating the image recording medium from the image carrier and comprising a metal plate extending from one of the bottoms of the outer case of the transfer unit to the downstream side thereof as viewed from the conveying direction of the image recording medium; the metal plate having a length measured perpendicular to the conveying direction of the image recording medium and a distal end; the distal end having a saw tooth shape along the length thereof and the outer case of the transfer unit being grounded.

With this arrangement, the metal plate is integrally connected to the outer case of the transfer unit and thus is connected to the ground, and the image recording medium is charged to a plus potential. Accordingly, the image recording medium is attracted to the metal plate and the image recording medium is separated from the image carrier. By forming the distal end of the metal plate in a saw tooth shape, it has been found that a disturbance of the toner images caused by the metal plate contacting the image recording medium is considerably mitigated. It is believed that the metal plate may contact the image recording medium by a portion of the metal plate near the distal end thereof and an attractive force between the metal plate and the image recording medium is distributed throughout the length of the image recording medium, as if points of attractive forces act were acting on the image recording medium, to thereby prevent displacement of the toner images and mitigate disturbance of the toner images.

Preferably, the metal plate has a width, measured parallel to the conveying direction of the image recording medium; which is larger than the distance between the image carrier and the transfer unit. Also preferably, the metal plate extends generally parallel to the image recording medium.

BRIEF DESCRIPTION OF THE DRAWINGS

The present invention will come more apparent from the following description of the preferred embodiments, with reference to the accompanying drawings, in which.

DESCRIPTION OF THE PREFERRED EMBODIMENTS

Figure 1:
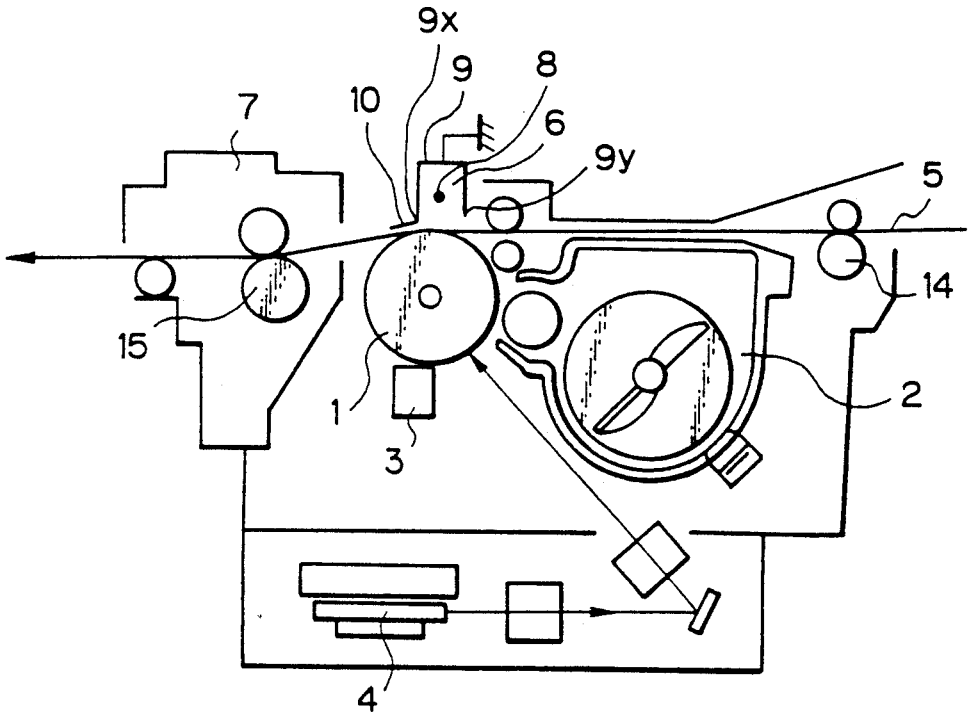
FIG. 1 is a diagrammatic side view of an electrophotographic recording apparatus according to the first embodiment of the present invention.

FIG. 1 shows an electrophotographic recording apparatus, according to the present invention which comprises a light-sensitive drum 1 as an image carrier having a light-sensitive surface layer, the electric conductivity of which changes in response to light, a developing unit 2 for depositing a toner on the surface of the light-sensitive drum 1 based on a potential difference between the surface of the light-sensitive drum 1 and toner, an electric charger 3 for uniformly charging the surface of the light-sensitive drum 1, an optical system 4 for forming latent images on the surface of the light-sensitive drum 1 by changing the amount of charging by laser scanning, a transfer unit 6 for transferring the toner images from the light-sensitive drum 1 to a paper 5 as an image recording medium, and a fixing unit 7 having a halogen lamp or the like to heat and fix the toner images on the paper 5. The paper 5 is conveyed to the light-sensitive drum 1 at the position of the transfer unit 6, and further to the fixing unit 7, in the direction of the arrow by pairs of conveying rollers 14 and 15.

The transfer unit 6, is arranged above the light-sensitive drum 1 at a specified distance from the light-sensitive drum 1. The transfer unit 6 has a charging wire electrode 8 causing a corona discharge for electrically charging the paper 5 to a plus potential and whereby the minus charged toner is attracted to the paper 5. The transfer unit 6 also has a spaced sidewalls with respective bottom edges generally U-shaped outer case 9, or housing with 9*x* and 9*y* near the path of travel of the paper 5 which encloses the charging wire electrode 8. The bottom edge 9*x* is on the downstream side of the other bottom edge 9*y* as viewed from the conveying direction of the paper 5. The outer case 9 is made from metal and connected to a ground as shown.

Figure 2:
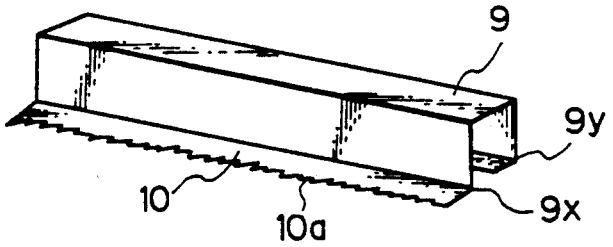
FIG. 2 is a perspective view of an outer case of a transfer unit of FIG. 1 with a paper separating plate integrally formed with the outer case.

As shown in FIGS. 1 and 2, a paper separating plate 10 extends from the bottom 9*x* to the downstream side thereof as viewed from the paper conveying direction. In the embodiment, the paper separating plate 10 is an integral portion of the outer case 9, bent from the vertical sidewall at the bottom edge 9*x*. However, it is possible to make the paper separating plate 10 separately from the outer case 9 and then attach the paper separating plate 10 to the outer case 9.

Figure 3:
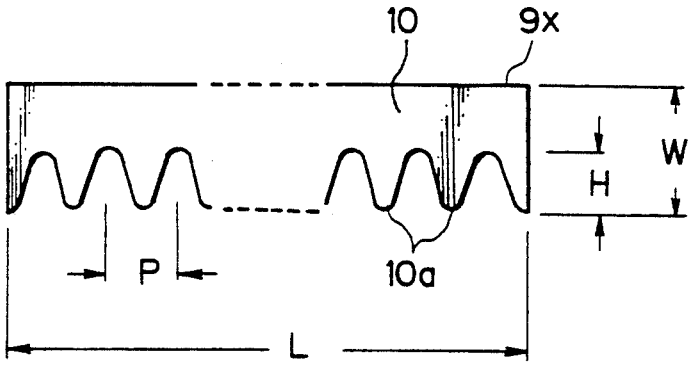
FIG. 3 is a detailed view of the distal end of the paper separating plate.

As shown in FIG. 3, the paper separating plate 10 has a length L, measured perpendicularly to the paper conveying direction, and a distal end that is remote from the bottom 9*x* of the outer case 9. The distal end has a saw tooth shape defined by teeth 10*a* along the length L thereof. The length L is typically 259 millimeters, and a pitch P between the adjacent teeth is 2 millimeters. The height H of each tooth is 2.4 millimeters and the top and the valley of each tooth are rounded.

Also, the paper separating plate 10 has a width W, measured in a direction parallel to the paper conveying direction; the width W (larger than 2 millimeters, for example) being larger than the distance (smaller than 2 millimeters, for example) between the light-sensitive drum 1 and the transfer unit 6, as shown in FIG. 1. The paper separating plate 10 extends generally parallel to the paper 5, and preferably, the paper separating plate 10 is slightly inclined relatively to the paper 5 on the downstream side of the light-sensitive drum 1 so that the distal end of the paper separating plate 10 is close to the paper 5.

In operation, latent images are formed on the light-sensitive drum 1 by the optical system 4, and the toner is adhered to the light-sensitive drum 1 to form toner images thereon at the developing unit 2, as is well known. Then the toner images are transferred from the light-sensitive drum 1 to the paper 5.

The paper separating plate 10 is connected to the ground, and the paper 5 is charged to a plus potential, whereby the paper 5 is attracted to the paper separating plate 10 and thus separated from the light-sensitive drum 1. Since the distal end of paper separating plate 10 is in a saw tooth shape, it has been found that a disturbance of the toner images caused by the paper separating plate 10 contacting the paper 5 is considerably mitigated. It is believed that an attractive force between the paper separating plate 10 and the paper 5 is distributed throughout the length of the paper 5 as if points of attractive forces act on the paper 5 to thereby prevent displacement of the toner images and mitigate disturbance of the toner images.

Figure 4:
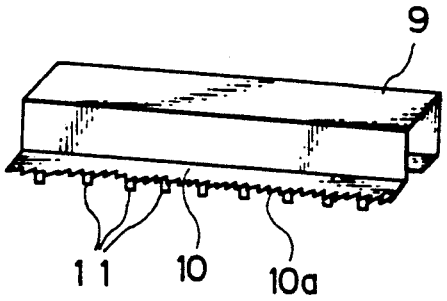
FIG. 4 is a perspective view of an outer case of a transfer unit according to the second embodiment of the present invention with a paper separating plate integrally formed with the outer case.

FIG. 4 shows an outer case 9 of a transfer unit 6 according to the second embodiment of the present invention with a paper separating plate 10 integrally formed with the outer case 9. The transfer unit 6 can be arranged in an electrophotographic apparatus in FIG. 1. In this embodiment, the paper separating plate 10 has a distal end having a saw tooth shape 10*a* along the length thereof and insulating members 11 are secured at the distal end of the paper separating plate 10. This arrangement prevents the paper 5 from electrically contacting the paper separating plate 10 to thereby prevent a concentration of forces attracting the paper 5, to thereby prevent displacement of the toner images and mitigate disturbance of the toner images.

As explained above, it is possible, according to the present invention, to obtain a means for separating an image recording medium from an image carrier by which the image recording medium can be separated from the image carrier with the images undisturbed and can be obtained at a low cost.

We claim:

1. In an electrophotographic recording apparatus including an image carrier for carrying toner images developed thereon, means for conveying an image recording medium to the image carrier in a predetermined direction along a conveying path, and a transfer unit, displaced by a prescribed distance from the image carrier for transferring the toner images from the image carrier to the image recording medium, the transfer unit having means for electrically charging the image recording medium and further having a generally inverted U-shaped housing enclosing the charging means and a pair of spaced sidewalls with respective bottom edges thereof disposed adjacent the conveying path and accordingly adjacent the surface of an image recording medium being conveyed along the conveying path, one of the bottom edges thereof being disposed downstream of the other in the conveying direction of the image recording medium, a separator which separates the images recording medium from the image carrier and comprises:

a metal plate extending from the downstream one of the bottom edges of the housing of the transfer unit and in the conveying direction of the image recording medium, the metal plate having a distal and extending along the length of the metal plate, as measured perpendicularly to the conveying direction of the image recording medium, the distal end having a saw tooth shape along the length thereof; and means for electrically grounding the housing of the transfer unit.

2. A separator according to claim 1, wherein the metal plate has a width, measured in a direction transverse to the length thereof and thus in a direction parallel to the conveying direction of the image recording medium, which is larger than the prescribed distance between the image carrier and the transfer unit.

3. A separator according to claim 2, wherein the metal plate extends in a direction generally parallel to the conveying direction of the image recording medium.

4. A separator according to claim 2, wherein the metal plate is integral with the downstream one of the bottom edges of the corresponding sidewall of the outer case of the transfer unit and is bent relatively to the respective sidewall so as to extend therefrom at an angle.

5. A separator according to claim 1, further comprising insulating members secured at the distal end of the metal plate and extending substantially. perpendicularly to the metal plate in a direction toward the conveying path.

* * * * *

UNITED STATES PATENT AND TRADEMARK OFFICE

CERTIFICATE OF CORRECTION

PATENT NO. : 5,221,952

DATED : June 22, 1993

INVENTOR(S) : ISHII et al.

It is certified that error appears in the above-indentified patent and that said Letters Patent is hereby corrected as shown below:

Col. 1, line 48, after "products" insert --in which--.

Col. 3, line 48, after "invention" insert --,--.

Col. 4, lines 4-8, delete the entire sentence: "The transfer ... electrode 8." and replace with: --The transfer unit 6 also has a generally U-shaped outer case, or housing, 9, with spaced sidewalls having respective bottom edges 9*x* and 9*y* disposed near the path of travel of the paper 5, which encloses the charging wire electrode 8.--

Signed and Sealed this

Fourteenth Day of June, 1994

Bruce Lehman

*Attest:*

BRUCE LEHMAN

*Attesting Officer*

*Commissioner of Patents and Trademarks*